US006860222B2

(12) United States Patent
Himmel

(10) Patent No.: US 6,860,222 B2
(45) Date of Patent: Mar. 1, 2005

(54) CONVERTIBLE DECK YACHT

(75) Inventor: Erwin L. Himmel, Barcelona (ES)

(73) Assignee: Fuore Design S.L., Barcelona (ES)

( * ) Notice: Subject to any disclaimer, the term of this patent is extended or adjusted under 35 U.S.C. 154(b) by 0 days.

(21) Appl. No.: 10/169,312

(22) PCT Filed: Mar. 1, 2002

(86) PCT No.: PCT/ES02/00093

§ 371 (c)(1),
(2), (4) Date: Nov. 22, 2002

(87) PCT Pub. No.: WO02/070335

PCT Pub. Date: Sep. 12, 2002

(65) Prior Publication Data

US 2003/0127037 A1 Jul. 10, 2003

(30) Foreign Application Priority Data

Mar. 5, 2001 (ES) ..... 200100574

(51) Int. Cl.[7] ..... B63B 17/00
(52) U.S. Cl. ..... 114/361
(58) Field of Search ..... 114/361, 344; 296/26.04

(56) References Cited

U.S. PATENT DOCUMENTS

| | | | | |
|---|---|---|---|---|
| 2,280,729 A | | 4/1942 | Sutton | |
| 3,800,726 A | * | 4/1974 | Murphy | 114/61.22 |
| 3,972,544 A | * | 8/1976 | Soot | 296/156 |
| 5,044,298 A | | 9/1991 | Pepper et al. | |
| 5,280,133 A | * | 1/1994 | Nath | 174/52.1 |
| 5,474,013 A | * | 12/1995 | Wittmaier | 114/288 |
| 5,615,633 A | | 4/1997 | Cripe | |
| 5,692,454 A | * | 12/1997 | Testa | 119/69.5 |

FOREIGN PATENT DOCUMENTS

| | | |
|---|---|---|
| DE | 199 51 619 A1 | 4/2001 |
| EP | 0 825 104 A2 | 2/1998 |
| WO | WO 93/04912 | 3/1993 |

* cited by examiner

*Primary Examiner*—Sherman Basinger
(74) *Attorney, Agent, or Firm*—Dickstein, Shapiro, Morin & Oshinsky, L.L.P.

(57) ABSTRACT

A yacht includes a lower area (1), an upper area (2) or deck, a vertically moveable roof (3) forming part of the craft and drive means for covering or uncovering said upper area (2), e.g., hydraulically driven telescopic bars (4). The roof (3) can include solar panels for energy generation and its design keeps the external aesthetic line of the yacht when it is in the closed position.

11 Claims, 2 Drawing Sheets

1
2
3
4

CONVERTIBLE DECK YACHT

In the field of pleasure crafts, the state of the art comprises crafts referred to as 'targa' type and crafts referred to as 'flybridge' type.

The first type corresponds to small and agile crafts having powerful motors making its use to be in a sports environment. The special design of this type of pleasure crafts is characterized in that the deck has a large outer space while the inner space (the habitable area) is reduced. The craft driving area and the relax area are provided outside the deck.

The main disadvantage of this type of craft is that its sport design provides an inner habitable space which is very reduced and further it has to be usually accessed by going downstairs to the lower part of the craft, thus negatively influencing on the access comfort. As the external area is uncovered, it is exposed to the sun, dirt, corrosion, etc.

The crafts of the second type are usually somewhat bigger and conceptually they come from the cruisers. They have a notably inner space larger than that in the previously described crafts, while the outer space of the deck is very reduced. These crafts are usually provided with two craft driving areas: an inner driving area and an outer driving area. The habitable area is provided inside the deck, together with a small terrace and one of said craft driving areas. The other craft driving area and a very small relax area are provided at the outer area (uncovered area).

The disadvantages of this second type of bulky and not very aesthetic crafts is the space waste, since two craft driving areas are provided (the inner area and the outer area), this especially having an influence on the limited usable outer space. The outer area is further uncovered and therefore it is exposed to the sun, dirt, corrosion, etc.

The present invention consists of a new craft (yacht) having a convertible cover cover comprising an inner or habitable area, an upper or relax area corresponding to the deck of the boat and a moveably roof.

The yacht of the invention has been developed with the purpose of overcoming the disadvantages derived from both types of crafts, further providing numerous advantages and other improvements as it win be described hereinafter.

The main feature of the yacht with convertible deck of the present invention is that the yacht is provided a movable roof which is a hard structure which is vertically movable with regard to the deck by drive means which allows the upper area to be automatically covered or uncovered. Said hard structure of the moveably roof is part of the yacht hull thus configuring a compact, aerodynamic structure.

According to a further aspect of the present invention, the roof drive means comprise a number of telescopic bars which are hydraulically driven to allow the vertical displacement of the roof. Said drive means include a compressor forcing a fluid to flow causing the movement of the roof. Said compressor is powered by the batteries of the yacht or by any other alternative known means. There are also provided roof activation means fitted in the yacht to easily drive said roof from the inside.

Therefore, it is possible to leave the upper area pr outer area covered or uncovered depending on the use of the craft that is to be made.

In the yacht of the invention, the hard roof of the deck is a part thereof, wherein solar panels are allowed to be fitted therein. By fitting said solar panels, the craft of the invention may be powered by clean energy for the different functions in which a generator is usually needed, such as on board systems, water, electricity for devices as the refrigerator, lighting, the kitchen, hot water, the oven, the air conditioning, etc.

The technological contribution of the present invention involves a technical solution to the drawbacks arising from the previously described types of pleasure crafts. Arrangement of a hydraulic mechanism that fully closes the deck provides a high protection for the deck and for the objects existing therein from the sun, the air, the dirt, the corrosion, etc.; as well as a high security since fully closing of the craft is thus facilitated. If solar panels are fitted in the roof in said mechanism a higher quantity of clean energy would be generated.

In addition, due to the special design of the yacht of the invention useful surfaces can be increased, both in the inner area and in the upper area. This craft has a driving area located at a central position, between the inner (lower) area and the upper area. The driving area can be completely covered being part of the interior of the craft or it can be fully opened being part of the exterior thereof thanks to said movable roof.

In the closed position, driving of the craft is carried out with the cab closed. In this position, the outer space of the deck is very wide and the furniture and all the objects are covered and completely protected. This is the appropriate position to leave the craft anchored in port and depart therefrom without having to perform manual operations and with the security of an hermetic and total closing.

In the open position, driving of the craft is carried out with the cab open but with a deck that, as per the user's convenience, protects the user from the sun. The outer area exhibits a large useful space so that a large dimension space protected from the sun is provided. This area is located at the central part of the craft and it is surrounded by the sunbathing areas.

With the described design a third type of craft is added to the previously described designs in connection with the state of the art. This new configuration gives rise to a polyvalent craft since a space open to the outside or a completely covered space are provided, thus further obtaining a significant increase of the habitable spaces, whether they are inner or outer.

The features and the advantages of the convertible deck craft of the present invention will be apparent from the detailed description of a preferred embodiment thereof that will be given hereinafter by way of a non limitative example in connection with the accompanying drawings, in which.

A detailed list of the various parts cited in the present invention is given below: (1) lower or habitable area, (2) upper or relax area, (3) vertical movable roof, and (4) telescopic bars.

The convertible deck yacht that is herein described according to the appended figures comprises a lower or habitable area (1) where the kitchen, the dining room, the rooms, etc. are provided. It further comprises an upper or relax area (2) having a wide lounge corresponding to the deck of the yacht.

The outer area (2) can be covered or uncovered by providing a vertically movable roof (3). The height-movable roof (3) exhibits a design such that it maintains the external aesthetic line of the craft when it is in the closed position, as it can be seen in FIG. 1 of the drawings in the present specification.

The yacht of the embodiment herein described by way of a non limitative example is provided with means to drive the roof (3) so that it can be automatically vertically moved so that the upper area (2) may be left covered or uncovered depending on the use of the craft that it is to be made.

Leaving the roof in the closed position (FIG. 1) the yacht looks more sporty, while if it is used with the roof in the open position (FIG. 2) it is configured as a more tourist yacht model.

The roof (3) is driven by means of a plurality of hydraulically driven telescopic bars (4) to allow vertical displacement of the roof (3). The bars (4) are moved by means of an hydraulic fluid that is forced to flow by a compressor powered by the batteries of the yacht themselves.

The movement of the roof (3) is adjusted by a control device fitted in the craft so that it can be easily actuated from the inside.

The roof (3) fully closes the deck protecting the existing objects inside the craft and therefore also providing a high security.

Figures 1, 2:
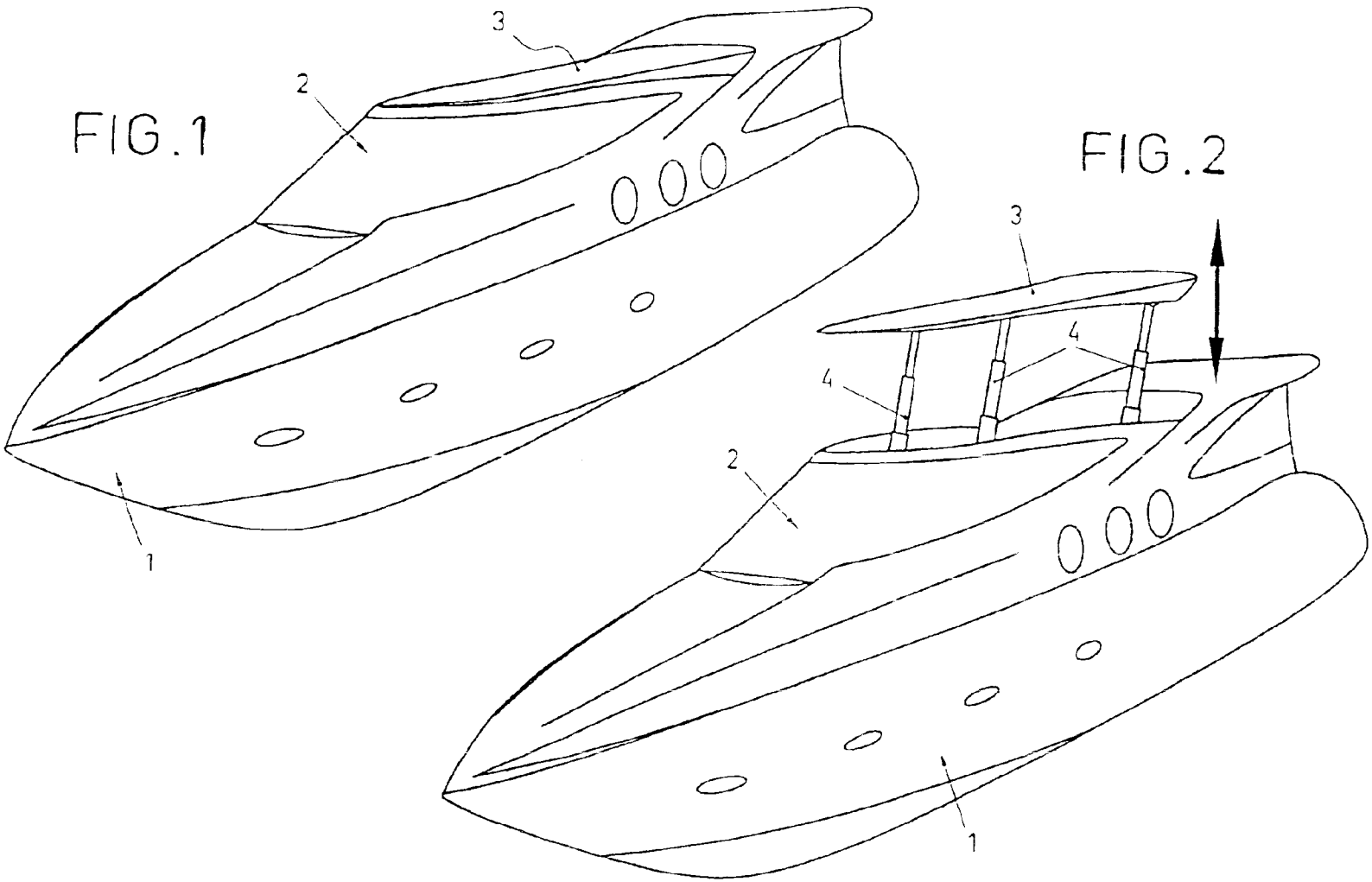
FIG. 1 is a perspective view of an embodiment of a yacht according to the invention with the roof in the closed position.
FIG. 2 is a perspective view of an embodiment of a yacht according to the invention with the roof in the open position.
Figure 3:
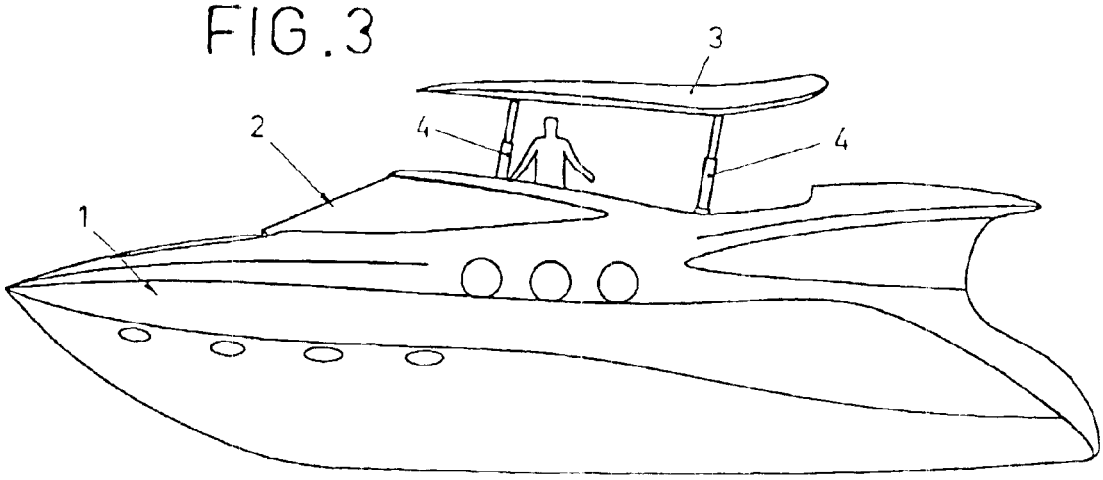
FIG. 3 is a side elevational view of the convertible deck yacht of FIG. 1.
Figure 4:
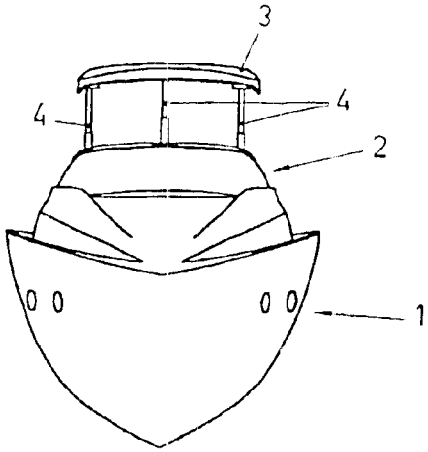
FIG. 4 is a front elevational view of the convertible deck yacht of FIG. 1.

In the closed position, see FIG. 1, driving of the yacht is carried out with the cabin closed. The external space of the upper area or deck (2) is very wide since a unification of the spaces is established and the whole interior of the craft is a single unit. This is the appropriate position to leave the yacht anchored at the port and depart therefrom without having to perform manual operations and with the security of an hermetic and total closing.

In the open position, see FIG. 2, the driving of the yacht is carried out with the cabin opened, with the advantage that the interior of the cabin is protected from the sun by the deck (2). In this position, a large useful space is obtained in that a large dimensioned lounge protected from the sun is provided.

Once having been sufficiently described with reference to the drawings, it is understood that any detail modification can be introduced as appropriate, provided that variations do not alter the essence of the invention.

What is claimed is:

1. A convertible deck yacht comprising a hull having a bow and a stern, a lower habitable area (1), an upper relax area (2) corresponding to the yacht deck and a roof (3) vertically moveably between a raised open position and a lowered closed position, wherein said roof is vertically disposed over said upper area and said upper area is vertically disposed over the lower area, wherein said upper area has a top portion containing a roof opening adapted to be closed by said roof, and wherein said roof (3) is a hard structure which is vertically movable relative to the yacht deck by drive means allowing to cover or uncover said upper area (2) and when the roof (3) is in a lower position, it fully closes the roof opening of said upper area (2) and forms a continuation of a surface extending from the bow of the yacht hull toward the stern of the yacht hull configuring a compact, aerodynamic structure.

2. A convertible deck yacht according to claim 1, wherein said drive means of the roof (3) comprise a plurality of hydraulically driven telescopic bars (4) allowing the vertical displacement of the roof (3).

3. A convertible deck yacht according to claim 2, further including an activator for movement the drive means.

4. A convertible deck yacht according to claim 3, wherein the roof (3) includes solar panels for energy generation.

5. A convertible deck yacht according to claim 4, wherein the hard roof (3) of the deck has a design such that it keeps the external aesthetic line of the yacht when it is in the closed position.

6. A convertible deck yacht according to claim 1, further including an activator for movement the drive means.

7. A convertible deck yacht according to claim 6, wherein the roof (3) includes solar panels for energy generation.

8. A convertible deck yacht according to claim 7, wherein the hard roof (3) of the deck has a design such that it keeps the external aesthetic line of the yacht when it is in the closed position.

9. A convertible deck yacht according to claim 1, wherein the roof (3) includes solar panels for energy generation.

10. A convertible deck yacht according to claim 9, wherein the hard roof (3) of the deck has a design such that it keeps the external aesthetic line of the yacht when it is in the closed position.

11. A convertible deck yacht according to claim 1, wherein the hard roof (3) of the deck has a design such that it keeps the external aesthetic line of the yacht when it is in the closed position.

* * * * *